US008127775B2

(12) United States Patent
Tokko

(10) Patent No.: US 8,127,775 B2
(45) Date of Patent: Mar. 6, 2012

(54) HAIR EXTENSION

(76) Inventor: Ryan Tokko, Los Angeles, CA (US)

( * ) Notice: Subject to any disclaimer, the term of this patent is extended or adjusted under 35 U.S.C. 154(b) by 58 days.

(21) Appl. No.: 12/758,580

(22) Filed: Apr. 12, 2010

(65) Prior Publication Data

US 2011/0247643 A1 Oct. 13, 2011

(51) Int. Cl.
*A41G 3/00* (2006.01)
*A41G 5/00* (2006.01)

(52) U.S. Cl. ..... 132/201

(58) Field of Classification Search ..... 132/53–56, 132/201
See application file for complete search history.

(56) References Cited

U.S. PATENT DOCUMENTS

| | | | | |
|---|---|---|---|---|
| 517,107 | A * | 3/1894 | Lambert | 132/53 |
| 544,559 | A * | 8/1895 | Beck | 132/53 |
| 1,351,427 | A * | 8/1920 | Krasmauskis | 132/53 |
| 6,832,614 | B2 * | 12/2004 | Frazier | 132/53 |

* cited by examiner

*Primary Examiner* — Robyn Doan
(74) *Attorney, Agent, or Firm* — Chanmin Park

(57) ABSTRACT

A hair extension includes a weft having an upper edge and a lower edge, a plurality of hair strands that are attached to the weft and are suspended below the lower edge of the weft, and a plurality of elongated rods. Each rod includes a base that is attached to the weft, and an extended portion that extends from the base and is adapted to be inserted into a tube for holding hair strands. The weft has a predetermined width. The extended portion of the rod protrudes from the upper edge of the weft, and is bent toward the lower edge of the weft. The extended portion includes a free end that is spaced from the weft by a predetermined distance. The base is embedded within the weft.

5 Claims, 3 Drawing Sheets

FIG.1
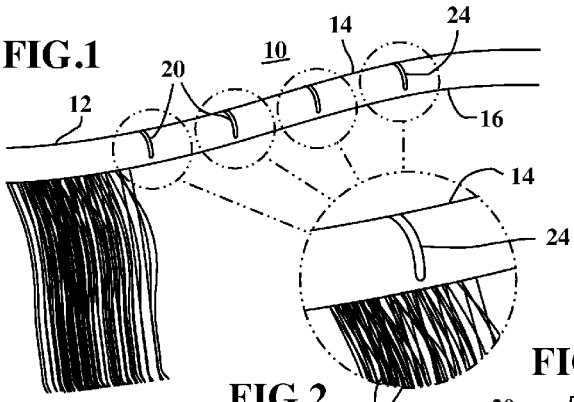
FIG.2
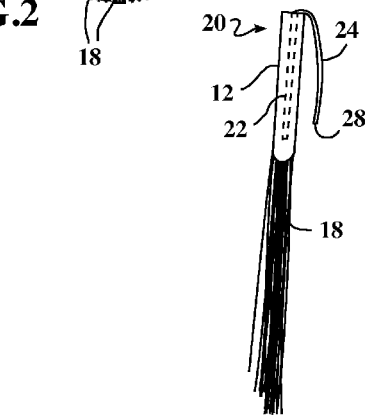
FIG.3
FIG.4
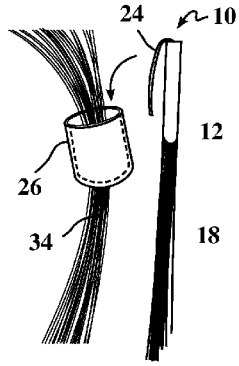
FIG.5
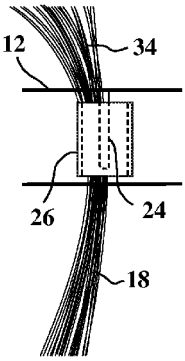

HAIR EXTENSION

CROSS REFERENCE TO RELATED APPLICATION

This application is based on provisional application No. 61/188,730 that was filed on Aug. 12, 2008 by the inventor. The contents of the provisional application is incorporated by reference as if they were fully disclosed herein.

BACKGROUND OF THE INVENTION

1. Field of the Invention

The invention is related to hair extension. More particularly, the present invention is related to a reusable hair extension and method therefor that are time-saving and minimize inconvenience such that the user feels that her hair is pulled unnaturally and awkwardly.

Hair extensions are used to provide decorative effects, such as long hair, curly hair, hair of various colors, etc. Hair extensions are commonly attached to natural hair of a user by attaching a weft hair on multiple locations along the weft hair. Weft hairs are expensive products. Since they are also durable, there has long been a need for effective system and method for reusing weft hairs or hair extensions.

2. Description of the Prior Art

US Patent Application Publication No. 2008/0295856 by Kallabat et al. discloses a method in which tubes are fixed to a weft hair; client's hair is passed through the fixed tube; and then tube is squeezed with a piler. A disadvantage of this method is that when a tube is squeezed and then unsqueezed more than one time, the tube is broken and no longer reusable. To use the weft hair again, tubes must be individually sewn to the weft hair again.

U.S. Pat. No. 7,533,676 to Sthair discloses a hair extension that uses an adhesive tape to fix the extension to user's hair. Disadvantages of this invention are that when the extension is detached, glue may remain on the user's hair causing inconvenience and that thus washing is required to remove the glue residue after detaching the hair extension.

U.S. Pat. No. 7,343,921 to Salinas discloses a method for hair extension, in which client's hair is passed through holes provided in a weft and then tied with a clip. A disadvantage of this method is that it is time consuming.

SUMMARY OF THE INVENTION

An objective of the invention is to provide a reusable hair extension that is easy and time saving to detach from client's hair and to reattach to client's hair.

In order to achieve the objective, the present invention provides a hair extension that includes a weft having an upper edge and a lower edge, a plurality of hair strands that are attached to the weft and are suspended below the lower edge of the weft, and a plurality of elongated rods, each of which includes a base that is attached to the weft, and an extended portion that extends from the base and is adapted to be inserted into a tube for holding hair strands. The weft has a predetermined width.

The extended portion of the rod protrudes from the upper edge of the weft, and is bent toward the lower edge of the weft. The extended portion comprises a free end that is spaced from the weft by a predetermined distance.

The base is embedded within the weft.

In one embodiment, the extended portion of the rod includes a bent portion. The bent portion is provided near the free end of the extended portion, and the bent portion is closer to the weft than the free end.

In another embodiment, the extended portion of the rod is elastic and the free end of the extended portion has an arrowhead shape.

In still another embodiment, the extended portion of the rod has flat and thin cross-section.

The present invention also provides a method of attaching the hair extension to a client's hair, the steps of which includes a) inserting strands of client's hair into a tube, b) assembling the tube with the hair extension by inserting the extended portion of the hair extension into the tube, c) fixing the weft to the client's hair, and d) repeating steps a), b) and c) for the remaining rods of the hair extension. In step c) the weft is fixed to the client's hair by squeezing the tube whereby the extended portion of the weft and client's hair are fastened together with the squeezed tube.

In another embodiment, in step b) the client's hair pass through a first tube and a second tube that are connected to each other and the first tube that is positioned closer to the free end of the client's hair is squeezed whereby the client's hair is fixed to the first tube, and the extended portion is inserted into the second tube, and in step c) the weft is fixed to the client's hair by squeezing the second tube whereby the extended portion of the weft and client's hair are fastened together with the squeezed second tube.

The advantageous effects of the present invention are: (1) fast service is possible because hook-shaped devices are pre-installed on the weft and the device is fixed together with a tube and client's hair that has been passed through the tube; (2) side effects after hair extension service including uneven pulling of the hair are minimized; (3) the weft can be reused without any additional treatment after detaching the weft from the tubes.

BRIEF DESCRIPTION OF THE DRAWINGS

The accompanying drawings illustrate the best embodiments of the present invention. In the drawings:

FIG. 1 is a perspective view showing a hair extension according to the present invention;

FIG. 2 is an enlarged perspective view showing a hook fixed to a weft;

FIG. 3 is a cross-sectional view showing how the hook is fixed to the weft;

FIG. 4 is a perspective view showing a method of fixing the weft to a client's hair according to the present invention;

FIG. 5 is an elevation view showing that the weft is fixed to the client's hair;

DESCRIPTION OF PREFERRED EMBODIMENTS

Figure 6:
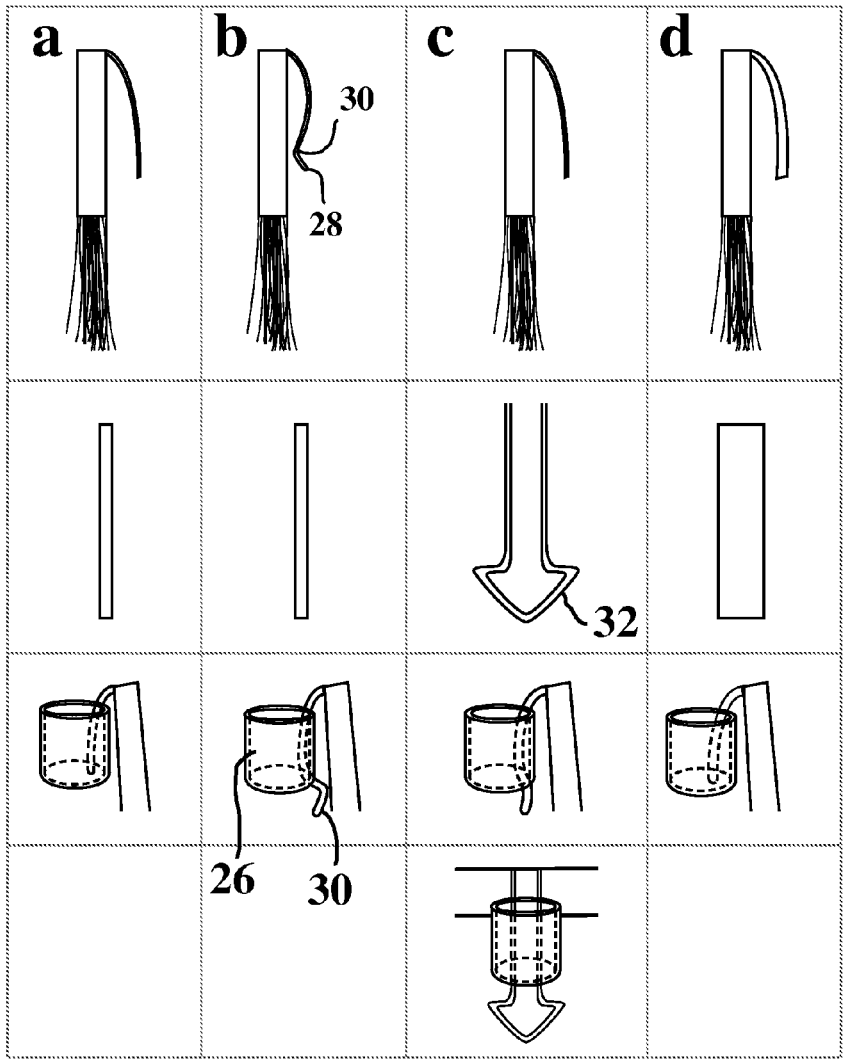
FIG. 6 is a table showing different types of hooks for the hair extension according to the present invention.
Figure 7:
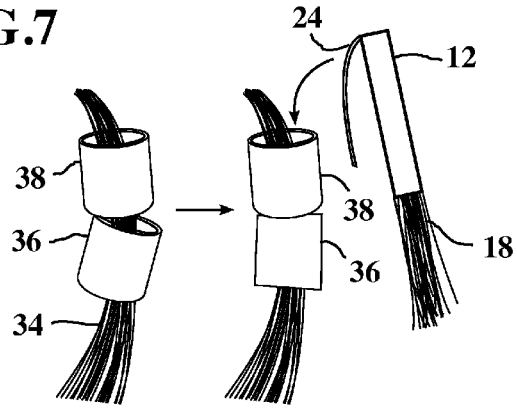
FIG. 7 is a perspective view showing another embodiment in which two tubes are used together.
Figure 8:
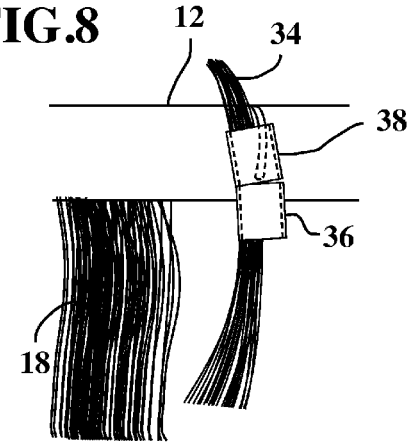
FIG. 8 is an elevation view showing that the weft is fixed to the client's hair.

FIG. 1 and FIG. 2 show a hair extension 10 that includes a weft 12 having an upper edge 14 and a lower edge 16, a plurality of hair strands 18 that are attached to the weft 12 and are suspended below the lower edge 16 of the weft, and a plurality of elongated rods 20, each of which includes a base 22 that is attached to the weft (refer to FIG. 3), and an extended portion 24 that extends from the base 22 and is adapted to be inserted into a tube 26 (refer to FIG. 4) for holding hair strands. The weft 12 has a predetermined width.

As shown in FIG. 3, the extended portion 24 of the rod 20 protrudes from the upper edge 14 of the weft 12, and is bent toward the lower edge 16 of the weft. The extended portion 24 comprises a free end 28. The base 22 can be fixed to the weft 12 by any method that provides stable fixing with minimum space. In the embodiment shown on FIG. 3, the base 22 is embedded within the weft 12.

The dimensions of the elements are decided to facilitate attaching hair extension and to provide firm attachment. The length of the extended portion 24 is 0.2~1.5 cm. The width of the weft 12 is 0.5~1.5 cm. The spacing between two adjacent rods 20 is 0.5~4 cm.

FIG. 6 shows four different types of the extended portion 24. In the table of FIG. 6, the first row is a view at the cross-section of the weft 12. The second row is a view of the extended portion 24 from a direction perpendicular to the weft 12. The third row shows how the extend portion 24 is inserted into the tube 26. Type A has straight extended portion.

Type B includes a bent portion 30. The bent portion 30 is provided near the free end 28 of the extended portion 24, and the bent portion 30 is closer to the weft 12 than the free end 28. The bent portion 30 prevents the tube 26 from falling off the rod.

For type C, the extended portion of the rod is elastic and the free end of the extended portion has an arrowhead shape 32. The free end is deformed when it passes through the tube 26 and restores to its original shape when is protrudes out of the tube 26. The fourth row of the table shows how the arrowhead shape prevents the tube from falling off the rod.

For type D, the extended portion of the rod has flat and thin cross-section. Type A, B, C rods are made of metal wire, and Type D rod is made of plastic.

The present invention also provides a method of attaching the hair extension 10 to a client's hair 34, the steps of which includes a) inserting strands of client's hair 34 into the tube 26 (refer to. FIG. 4), b) assembling the tube 26 with the hair extension 10 by inserting the extended portion 24 of the hair extension 10 into the tube 26 (refer to FIG. 4), c) fixing the weft 12 to the client's hair 34 (refer to FIG. 5), and d) repeating steps a), b) and c) for the remaining rods 20 of the hair extension 10.

In step c) the weft 12 is fixed to the client's hair 34 by squeezing the tube 26 whereby the extended portion 24 of the weft 12 and client's hair 34 are fastened together with the squeezed tube 26 with a tool such as a plier. To detach the hair extension 10, the tubes 26 are opened with a tool and the client's hair 34 is freed by taking it out of the tubes 26. When reusing the hair extension, new tubes are used and the above method can be repeated.

Figure 9:
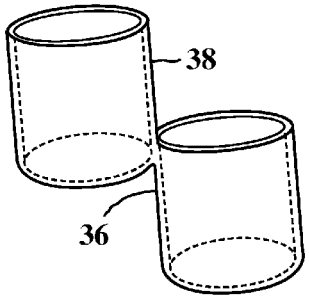
FIG. 9 is a perspective view showing a first scheme to use two tubes together.
Figure 10:
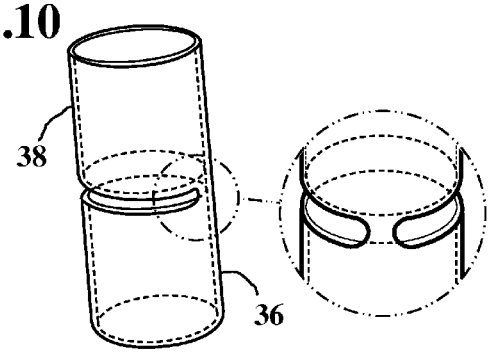
FIG. 10 is a perspective view showing a second scheme to use two tubes together.

FIGS. 7~10 show another embodiment for the method. In step b) the client's hair 34 pass through a first tube 36 and a second tube 38 that are connected to each other and the first tube 36, which is positioned closer to the free end of the client's hair 34, is squeezed whereby the client's hair 34 is fixed to the first tube 38, and the extended portion 24 is inserted into the second tube 38, and in step c) the weft 12 is fixed to the client's hair 34 by squeezing the second tube 38 whereby the extended portion 24 of the weft 12 and client's hair 34 are fastened together with the squeezed second tube 38. The first tube 36 has a role of a jig that holds the client's hair so that the second tube 38 can be handled much more easily without worrying about the tube falling from the client's hair. FIGS. 9 and 10 show examples of how the first tube 36 and the second tube 38 are connected to each other.

The invention claimed is:

1. A method of attaching a hair extension to a client's hair, the steps of which comprises:

a) inserting strands of client's hair into a tube, b) assembling the tube with an hair extension, wherein the hair extension comprising a weft comprising an upper edge and a lower edge, wherein the weft has a predetermined width, a plurality of hair strands that are attached to the weft and are suspended below the lower edge of the weft, and a plurality of elongated rods, each of which comprises a base that is attached to the weft, and an extended portion that extends from the base and is adapted to be inserted into a tube for holding hair strands, wherein the tube is assembled with the hair extension by inserting the extended portion into the tube, c) fixing the weft to the client's hair, d) repeating steps a), b) and c) for the remaining rods of the hair extension.

2. The method of claim 1, wherein in step c) the weft is fixed to the client's hair by squeezing the tube whereby the extended portion of the weft and client's hair are fastened together with the squeezed tube.

3. The method of claim 2, wherein the extended portion of the rod protrudes from the upper edge of the weft, and is bent toward the lower edge of the weft, wherein the extended portion comprises a free end that is spaced from the weft by a predetermined distance.

4. The method of claim 3, wherein the base is embedded within the weft.

5. The method of claim 1, wherein in step b) the client's hair pass through a first tube and a second tube that are connected to each other and the first tube that is positioned closer to the free end of the client's hair is squeezed whereby the client's hair is fixed to the first tube, and the extended portion is inserted into the second tube, wherein in step c) the weft is fixed to the client's hair by squeezing the second tube whereby the extended portion of the weft and client's hair are fastened together with the squeezed second tube.

* * * * *